US007934450B2

(12) United States Patent
Kündgen et al.

(10) Patent No.: US 7,934,450 B2
(45) Date of Patent: May 3, 2011

(54) PRINTING PRESS

(75) Inventors: Rolf Kündgen, Bad Schönborn (DE); Gerd Merkel, Dielheim (DE); Bernd Sitzmann, Sandhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 864 days.

(21) Appl. No.: 11/728,570

(22) Filed: Mar. 26, 2007

(65) Prior Publication Data

US 2007/0221075 A1 Sep. 27, 2007

(30) Foreign Application Priority Data

Mar. 24, 2006 (DE) ..... 10 2006 013 749

(51) Int. Cl.
*B41F 7/02* (2006.01)

(52) U.S. Cl. ..... 101/218; 101/247

(58) Field of Classification Search ..... 101/216, 101/218, 247, 485, 486, 217
See application file for complete search history.

(56) References Cited

U.S. PATENT DOCUMENTS

| | | | | |
|---|---|---|---|---|
| 4,477,822 | A * | 10/1984 | Luoma et al. | 346/136 |
| 5,024,154 | A * | 6/1991 | Ito | 101/148 |
| 5,142,977 | A | 9/1992 | Gertsch et al. | |
| 5,662,038 | A * | 9/1997 | Schaum et al. | 101/76 |
| 5,690,029 | A * | 11/1997 | Herrmann et al. | 101/218 |
| 6,651,557 | B1 * | 11/2003 | Costin et al. | 101/218 |
| 6,694,877 | B1 * | 2/2004 | Wolters et al. | 101/218 |
| 2003/0075060 | A1 * | 4/2003 | Plewa | 101/216 |

FOREIGN PATENT DOCUMENTS

| | | |
|---|---|---|
| DE | 2 153 690 | 6/1972 |
| DE | 38 25 517 A1 | 2/1990 |
| DE | 44 27 967 A1 | 3/1995 |
| DE | 19701216 A1 | 7/1998 |
| DE | 4142791 C2 | 7/2002 |

* cited by examiner

*Primary Examiner* — Ren Yan
(74) *Attorney, Agent, or Firm* — Laurence A. Greenberg; Werner H. Stemer; Ralph E. Locher

(57) ABSTRACT

A printing press includes a form cylinder, a blanket cylinder, an impression cylinder, an adjusting apparatus having at least one first actuating drive for setting a printing pressure between the blanket cylinder and the impression cylinder, and a tracking system for setting a printing pressure between the form cylinder and the blanket cylinder in dependence on the setting of the printing pressure between the blanket cylinder and the impression cylinder. The tracking system has at least one second actuating drive coupled to the at least one first actuating drive in terms of control technology through an electronic control device, in such a way that the form cylinder is adjusted automatically.

3 Claims, 4 Drawing Sheets

PRINTING PRESS

CROSS-REFERENCE TO RELATED APPLICATIONS

This application claims the priority, under 35 U.S.C. §119, of German Patent Application DE 10 2006 013 749.3, filed Mar. 24, 2006; the prior application is herewith incorporated by reference in its entirety.

BACKGROUND OF THE INVENTION

Field of the Invention

The present invention relates to a printing press which includes a form cylinder, a blanket cylinder, an impression cylinder, an adjusting apparatus having at least one first actuating drive for setting a printing pressure between the blanket cylinder and the impression cylinder, and a tracking system for setting a printing pressure between the form cylinder and the blanket cylinder in dependence on the setting of the printing pressure between the blanket cylinder and the impression cylinder.

The invention arose against the following background: in offset printing units, the printing pressure between the blanket cylinder and the impression cylinder is set through the use of an adjusting apparatus as a function of the printed sheet thickness. For example, the blanket cylinder is displaced through the use of the adjusting apparatus to a somewhat greater axial spacing relative to the impression cylinder if the sheet thickness is increased as a consequence of a change in the print job. The offset printing unit includes a tracking system in order to ensure that the printing pressure between the blanket cylinder and the form cylinder does not change during the setting of the printing pressure between the blanket cylinder and the impression cylinder. If, therefore, the blanket cylinder is displaced to a somewhat greater spacing relative to the impression cylinder in the above example, the form cylinder is also displaced to a somewhat greater spacing relative to the impression cylinder through the use of the tracking system, with the result that the printing pressure between the blanket cylinder and the form cylinder is kept constant.

The printing pressure between the blanket cylinder and the impression cylinder can be set manually, for example through the use of a handwheel, as is described in German Patent DE 41 42 791 C2.

However, it is more favorable with regard to operating comfort if the printing pressure between the blanket cylinder and the impression cylinder is set through the use of an adjusting drive, as is described in German Published, Non-Prosecuted Patent Application DE 197 01 216 A1. The offset printing unit which is described in the above-mentioned prior art includes a purely mechanical tracking system for the form cylinder. Actuating mechanisms which are provided for the rotation of eccentric bushes of the form cylinder are coupled through an actuating shaft to the actuating mechanisms which are provided for the rotation of eccentric bushes of the blanket cylinder. Although only a single actuating drive is therefore required which acts on the actuating shaft through an actuating lever and both sets the printing pressure between the blanket cylinder and the impression cylinder and tracks the form cylinder, the functionality of the offset printing unit is restricted as a consequence of that construction.

It is namely desirable for it to be possible to change the axial spacing between the blanket cylinder and the form cylinder for defined operating modes independently of the printing pressure between the blanket cylinder and the impression cylinder. For example, an operating mode of that type exists if the offset printing unit co-rotates as what is known as an inactive printing unit and the printed sheets which are printed in other printing units of the printing press pass through the offset printing unit, without being printed therein. In order for it to be possible to operate the offset printing unit as an inactive printing unit, it is necessary in that operating mode to keep the blanket cylinder in its thrown-on position, in order to press the printed sheets which are transported on the impression cylinder against the impression cylinder by way of the blanket cylinder, and to keep the form cylinder at the same time at such a great spacing with respect to the blanket cylinder that bearer rings of the form cylinder are not in contact with bearer rings of the blanket cylinder. There, the blanket cylinder has a pure sheet guiding function and does not print. The canceled bearer ring contact between the bearer rings of the form cylinder and the blanket cylinder makes it possible to keep the form cylinder and the associated inking unit at a rotational standstill as a result of their decoupling from a gear mechanism or as a result of deactivation of a separate drive which is assigned to them during the operating mode.

SUMMARY OF THE INVENTION

It is accordingly an object of the invention to provide a printing press which overcomes the hereinafore-mentioned disadvantages of the heretofore-known devices of this general type and which has increased functionality.

With the foregoing and other objects in view there is provided, in accordance with the invention, a printing press. The printing press comprises a form cylinder, a blanket cylinder, an impression cylinder, and an adjusting apparatus having at least one first actuating drive for setting a printing pressure between the blanket cylinder and the impression cylinder. A tracking system sets a printing pressure between the form cylinder and the blanket cylinder in dependence on the setting of the printing pressure between the blanket cylinder and the impression cylinder. The tracking system has at least one second actuating drive. An electronic control device couples the at least one second actuating drive to the at least one first actuating drive in terms of control technology, for automatically adjusting the form cylinder.

The coupling through the use of control technology is exactly as functionally reliable as the mechanical positive coupling which is known from the prior art (German Published, Non-Prosecuted Patent Application DE 197 01 216 A1), but, in contrast to the latter, permits uncomplicated decoupling of the tracking system of the form cylinder from the adjusting apparatus of the blanket cylinder.

This decoupling can take place for the operating mode which has already been addressed, in order to change the axial spacing between the blanket cylinder and the form cylinder for that operating mode independently of the printing pressure between the blanket cylinder and the impression cylinder. The operator can bring about the decoupling and the change in the axial spacing by inputting the corresponding control commands into the electronic control device, for example by pressing a button.

In that operating mode, an offset printing unit which includes the form cylinder, the blanket cylinder and the impression cylinder can co-rotate as what is known as an inactive printing unit, and the printed sheets which are printed in other printing units of the printing press can pass through the inactive offset printing unit, without being printed therein. In order for it to be possible to operate the offset printing unit as an inactive printing unit, the electronic control device can control the adjusting apparatus of the form cylinder and the tracking system in this operating mode in such a way that the blanket cylinder is kept in its thrown-on position and the form cylinder is kept at the same time at such a great axial spacing relative to the blanket cylinder that bearer rings of the form cylinder are not in contact with bearer rings of the blanket cylinder. In this case, the blanket cylinder has a pure sheet guiding function, in that it presses printed sheets which are transported on the impression cylinder against the impression cylinder, without printing the printed sheets in the process.

The canceled bearer ring contact between the bearer rings of the form cylinder and the bearer rings of the blanket cylinder makes it possible to keep the form cylinder and optionally an inking unit which is assigned to the form cylinder at a rotational standstill in that operating mode, in which the blanket cylinder and the impression cylinder rotate. The rotational standstill can be brought about, for example, by the form cylinder and the inking unit being decoupled from a main drive which drives the blanket cylinder and the impression cylinder, or by a separate drive of the form cylinder and the inking unit, which is present in addition to the main drive, being deactivated during that operating mode.

In accordance with another feature of the invention, the tracking system includes a further second actuating drive and the second actuating drives are connected through spring limbs to eccentric bearings, in which the form cylinder is mounted.

In accordance with a further feature of the invention, a switching apparatus is provided for throwing the blanket cylinder on and off relative to the impression cylinder. The switching apparatus has an eccentric bearing on the drive side and an eccentric bearing on the operating side. The blanket cylinder is mounted in the eccentric bearings.

In accordance with an added feature of the invention, an adjusting apparatus is provided with stops for determining end positions of the eccentric bearings of the blanket cylinder, and actuating drives are provided for adjusting the stops.

In accordance with a concomitant feature of the invention, a common, single actuating apparatus is provided for rotating both eccentric bearings of the blanket cylinder. The eccentric bearings of the blanket cylinder are connected elastically to one another through a mechanism having a synchronizing shaft.

Other features which are considered as characteristic for the invention are set forth in the appended claims.

Although the invention is illustrated and described herein as embodied in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
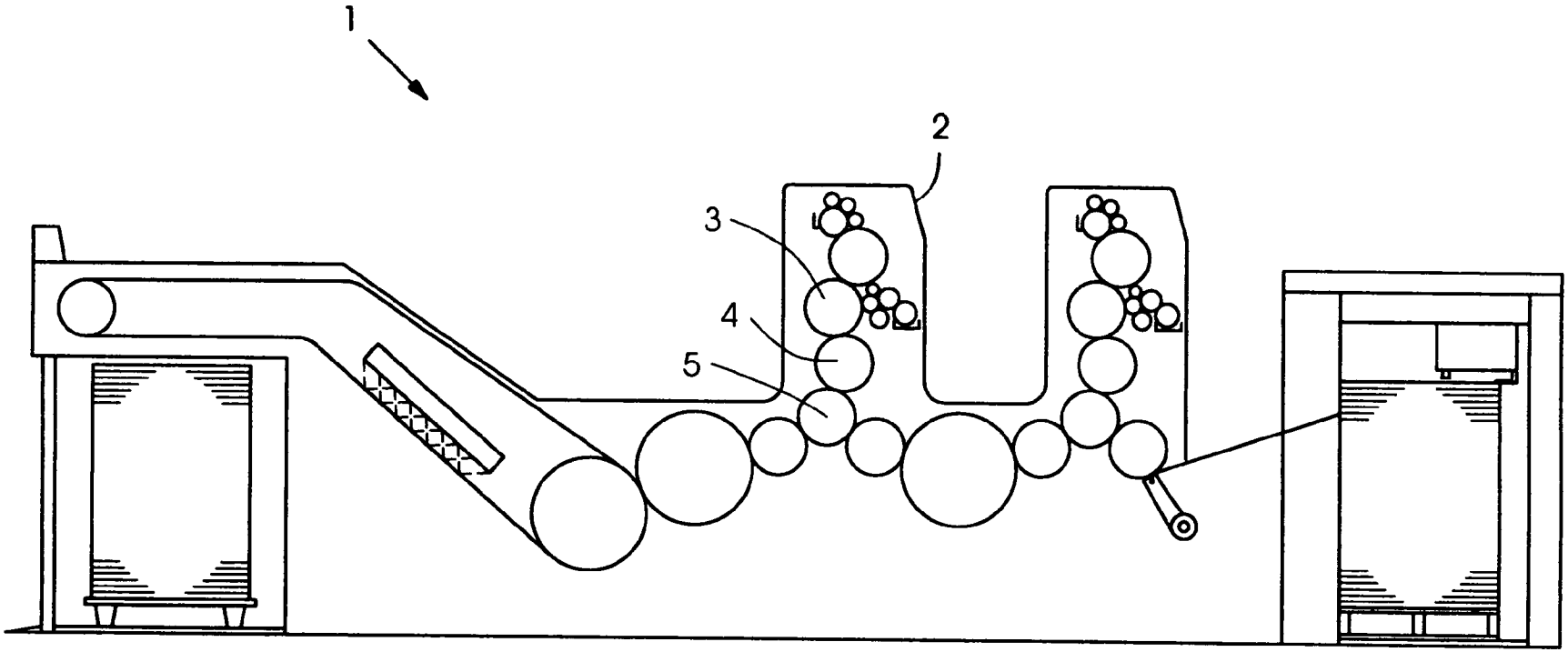
FIG. 1 is a diagrammatic, longitudinal-sectional view of a sheet-fed printing press having an offset printing unit.

Referring now to the figures of the drawings in detail and first, particularly, to FIG. 1 thereof, there is seen a printing press 1 which includes a printing unit 2 having a form cylinder 3, a blanket cylinder 4 and an impression cylinder 5. The printing press 1 is a sheet-fed printing press and the printing unit 2 is an offset printing unit.

Figure 2:
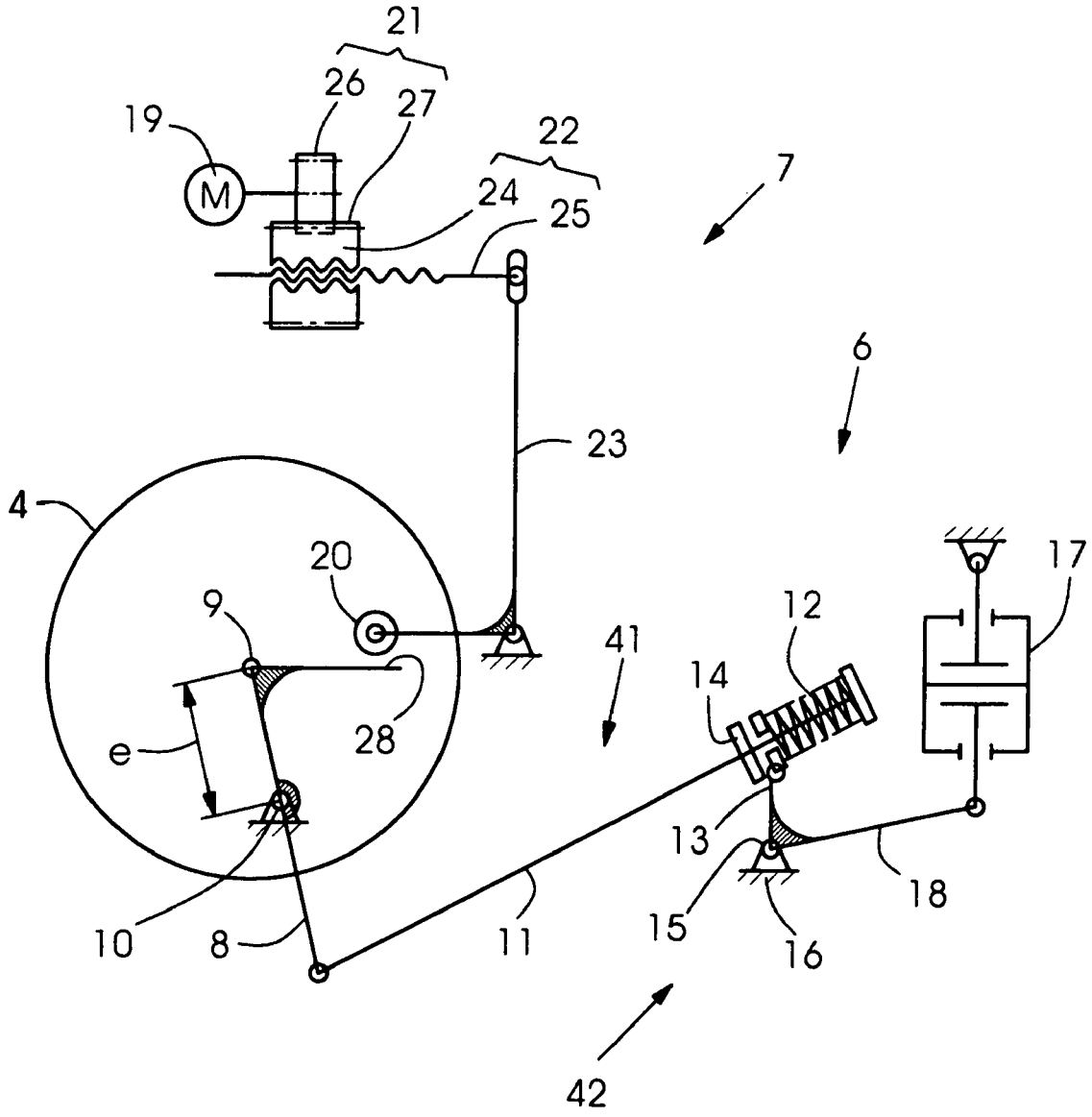
FIG. 2 is an enlarged, side-elevational view showing constituent parts of a switching apparatus for throwing on and off and an adjusting apparatus for setting a thickness of a printing material, disposed on an operating side of the printing press.
Figure 3:
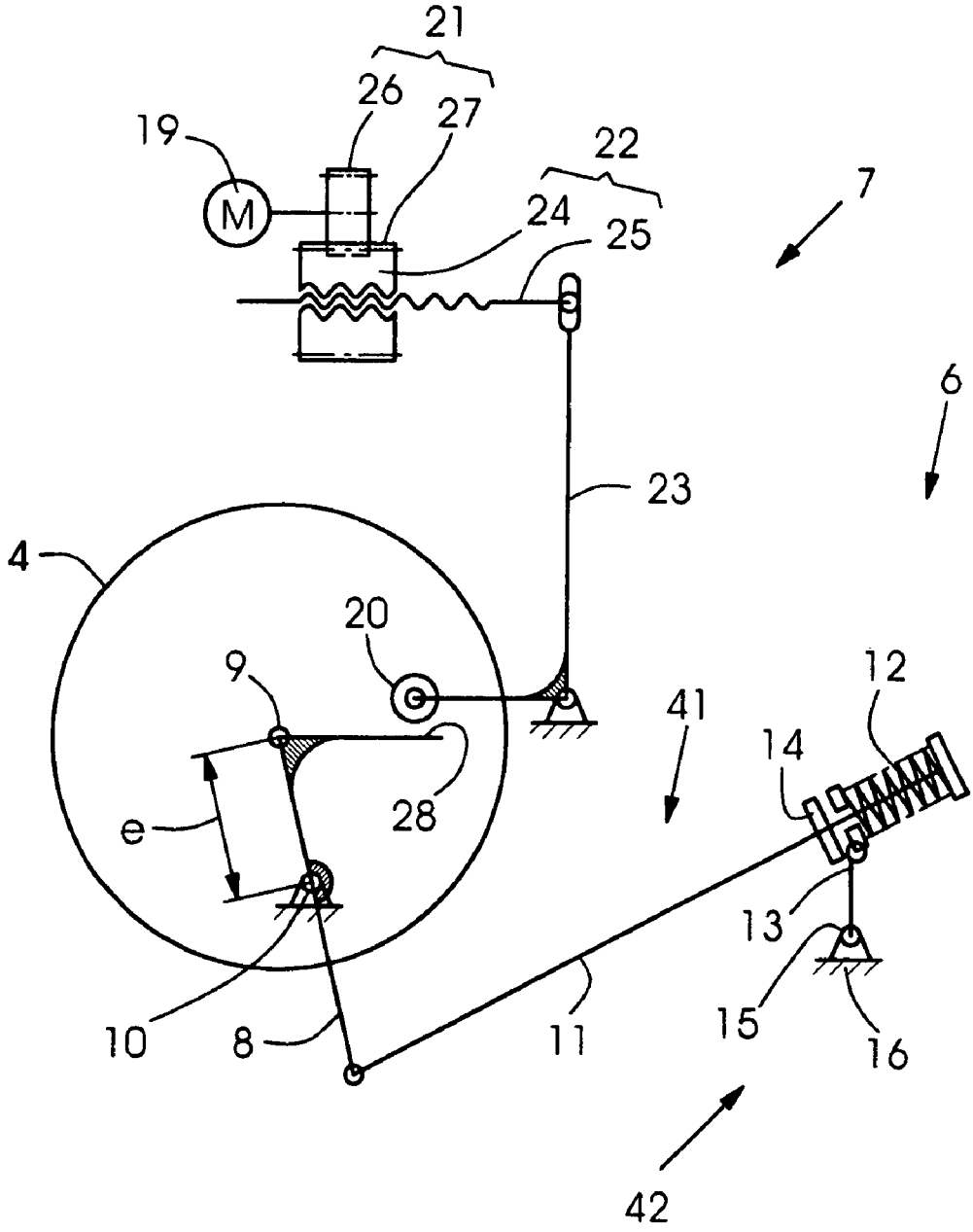
FIG. 3 is a view similar to FIG. 2 showing constituent parts of the switching apparatus and the adjusting apparatus, disposed on a drive side.

FIGS. 2 and 3 show a switching apparatus 6 for throwing the blanket cylinder 4 onto and off of the impression cylinder 5. The switching apparatus 6 serves for impression throw-on and throw-off. Furthermore, an adjusting apparatus 7 is provided for setting a force of a pressure of the blanket cylinder 4 on the impression cylinder 5. The adjusting apparatus 7 serves to set the printing pressure between the blanket cylinder 4 and the impression cylinder 5, wherein the printing pressure is dependent on the thickness of the printing material. The blanket cylinder 4 is mounted in an eccentric bearing 8 on a drive side (shown in FIG. 2) and in an identical eccentric bearing 8 on an operating side (shown in FIG. 3). The eccentric bearings 8 are eccentric bushes and are shown diagrammatically in FIGS. 2 and 3 by way of their eccentricity e. Axle journals of the blanket cylinder 4 are mounted rotatably in the eccentric bearings 8. Reference numeral 9 denotes a rotational axis of the blanket cylinder 4 and reference numeral 10 denotes a center axes of the eccentric bearings 8. The rotational axis 9 of the blanket cylinder 4 is displaced toward or away from the impression cylinder 5 by rotation of the eccentric bearings 8 about the center axes 10, depending on the rotational direction.

A coupler 11 which is connected in each case through a spring 12 to a lever 13, is articulated on each eccentric bearing 8. The springs 12 are configured as disk spring stacks and are each constituent parts of a spring bush 14, on which the corresponding lever 13 is articulated. The couplers 11 form spring limbs 41 together with the spring bushes 14. The lever 13 on the drive side (FIG. 2) is connected fixedly in terms of rotation to the lever 13 on the operating side (FIG. 3) through a synchronizing shaft 15. The synchronizing shaft 15 is mounted in a stationary manner in a machine frame 16 and, just like the spring limbs 41, is a constituent part of a transmission or mechanism 42 which connects the two eccentric bearings 8 to one another through the use of transmission or mechanism technology. An actuating apparatus 17 for rotating the synchronizing shaft 15 is articulated on an arm 18 which is connected fixedly in terms of rotation to the synchronizing shaft 15. The arm 18 can be one of two arms of the lever 13 on the drive side. The actuating apparatus 17 is present only on the drive side and not on the operating side, as is indicated by a comparison of FIG. 2 with FIG. 3. The single actuating device 17 serves to rotate both eccentric bearings 8, the one on the drive side and the one on the operating side. The actuating device 17 is a pneumatic operating cylinder having two pistons which are connected in series, that is to say it is what is known as a tandem cylinder.

Each adjusting apparatus 7 includes an actuating drive 19 for adjusting a stop 20 which limits a rotational angle of the respective eccentric bearing 8 during throwing on. The actuating drives 19 are electric motors and are connected to the corresponding stop 20 in each case through a gear transmission or mechanism 21, a screw transmission or mechanism 22 and a lever 23. Each screw mechanism 22 includes a nut 24 which is mounted rotatably in the machine frame 16 and into which a threaded spindle 25 is screwed. The threaded spindles 25 are articulated on the levers 23. The gear mechanisms 21 each include a gearwheel 26 which is seated on a motor shaft of the corresponding actuating drive 19. Moreover, the gear mechanisms 21 each include a crown gear 27 which is formed or fastened on the corresponding nut 24. The gearwheels 26 engage into the crown gears 27. The levers 23 are mounted in a stationary manner in the machine frame 16 and each have a first lever arm which is connected to the threaded spindle 25 and a second lever arm, on which the stop 20 is disposed. The stops 20 are configured as rollers. A projection 28 is situated on each eccentric bearing 8. The projection 28 strikes the respective stop 20 when the corresponding eccentric bearing 8 reaches its end position which is set through the use of the adjusting apparatus 7 during its rotation.

Figure 4:
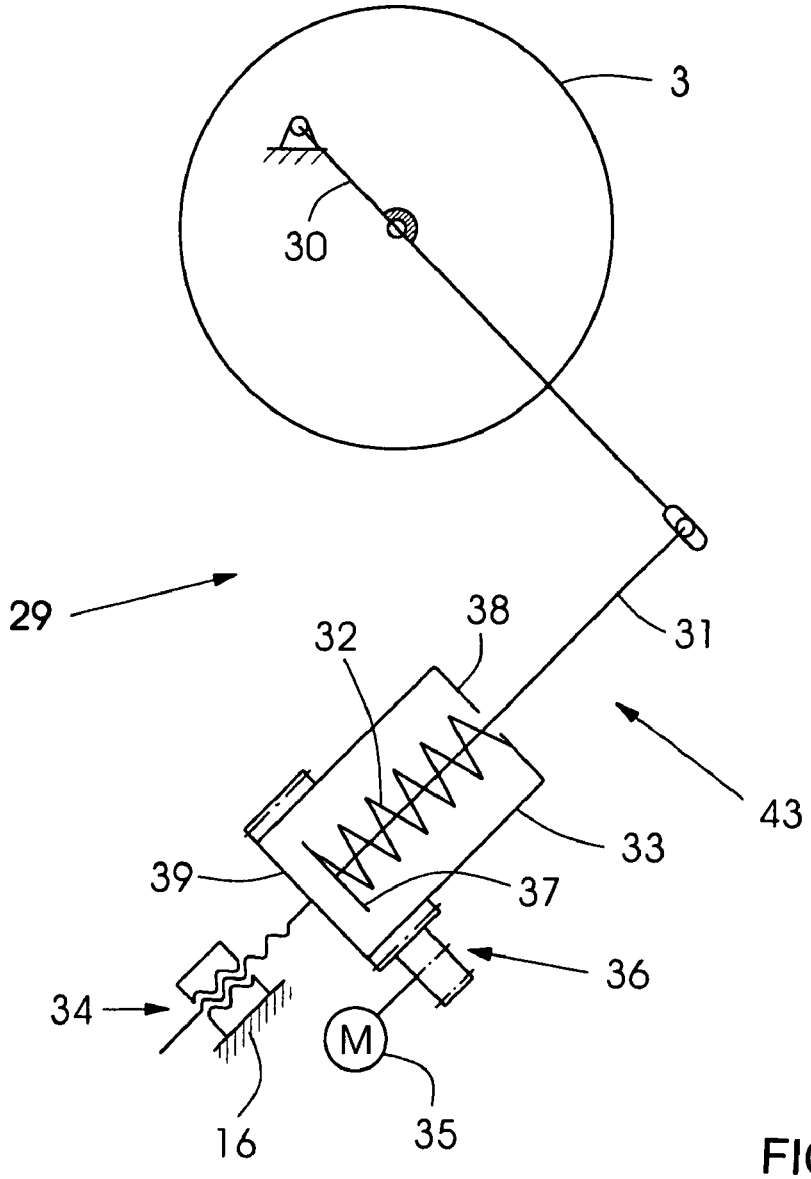
FIG. 4 is a side-elevational view of a tracking system for tracking a printing pressure as a function of changes in another printing pressure in the offset printing unit.

FIG. 4 shows an adjusting apparatus 29 for displacing the form cylinder 3 toward and away from the blanket cylinder 4. The adjusting apparatus 29 is present in each case once on the drive side and once on the operating side. Each adjusting apparatus 29 includes an eccentric bearing 30, the construction type of which (eccentric bush) corresponds to the eccentric bearings 8 which are shown in FIGS. 2 and 3, and is likewise shown only diagrammatically. A pull rod 31, which is loaded by a spring 32, is articulated on the eccentric bearing 30. The pull rods 31 together with the springs 32 form spring limbs 43. The spring 32 is supported with its one end on a head 37 of the pull rod 31 and with its other end on a base 38 of a sleeve 33. The sleeve 33 is mounted rotatably and is connected to the machine frame 16 through a screw transmission or mechanism 34. The screw mechanism 34 includes a nut which is disposed fixedly in terms of rotation on the machine frame 16 and a threaded spindle which is disposed on the sleeve 33 and is screwed into the nut. An adjusting drive 35, for rotating the eccentric bearing 30, is disposed in a stationary manner and is connected to the sleeve 33 through a gear transmission or mechanism 36. The adjusting drive 35 is an electric motor. The gear mechanism 36 includes a gearwheel which is seated on a motor shaft of the adjusting drive 35 and a crown gear which is formed or fastened on the sleeve 33.

The adjusting drive 35 rotates the sleeve 33 through the gear mechanism 36, and the rotation of the sleeve 33 is converted by the screw mechanism 34 into a translation of the sleeve 33. As a consequence of the translation, the sleeve 33 presses on the pull rod 31 through the spring 32. The resultant movement of the pull rod 31 brings about the rotation of the eccentric bearing 30 into a position, in which the required pressure of the blanket cylinder 4 (FIGS. 1 to 3) on the form cylinder 3 results when the blanket cylinder 4 is thrown onto the form cylinder 3 for the printing operation. A rotation of the actuating drive 35 and therefore of the sleeve 33 which takes place in the opposite direction results in their translation likewise in the opposite direction, in which the spring 32 is relieved and the sleeve 33 strikes the pull rod 31. The sleeve 33 has a base 39 which lies opposite the base 38 and comes into contact with the head 37 of the pull rod 31 in the last-mentioned translation and in the process moves the pull rod 31 back, with the result that the eccentric bearing 30 is rotated back into a position, in which the form cylinder 3 can no longer be contacted by the blanket cylinder 4 when the latter is displaced into its thrown-on position.

Figure 5:
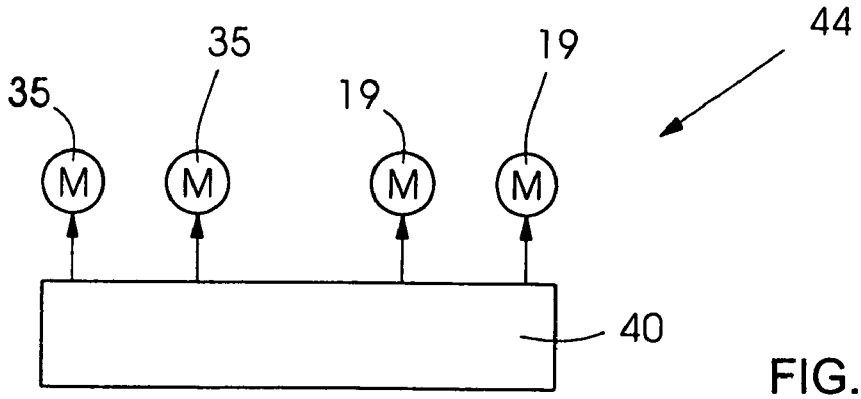
FIG. 5 is a schematic and block diagram showing electronic linking of actuating drives of the adjusting apparatus, which serves for setting the thickness of the printing material, to actuating drives of an adjusting apparatus, which serves for tracking.

FIG. 5 shows that the actuating drives 19 of the adjusting apparatuses 7 which serve to adjust the blanket cylinder 4 are linked through an electronic control apparatus 40 to the actuating drives 35 which serve to adjust the form cylinder 3. As a result, a tracking system 44 is present which tracks the printing pressure between the form cylinder 3 and the blanket cylinder 4 with the printing pressure between the blanket cylinder 4 and the impression cylinder 5, when the latter is changed.

The method of operation of the above-mentioned linking, in control technology terms, will become clear by using the following description of the overall relationship of the elements which are shown in FIGS. 1 to 5: the stops 20 are set through the use of the actuating drives 19 (FIGS. 2 and 3) as a function of the thickness of the sheets to be printed. For example, the stops 20 are set for processing paperboard sheets in such a way that the maximum rotational angle of the eccentric bearings 8 is greater than in a setting of the stops 20 which is provided for processing paper sheets. It is more likely that the projections 28 come into contact with the stops 20 in the case of a setting of the stops 20 which is provided for paper sheets, than in the case of a setting which is provided for paperboard sheets. The control apparatus 40 ensures tracking of the adjusting apparatuses 29 (FIG. 4) which is proportional to the setting of the adjusting apparatuses 7 (FIGS. 2 and 3). For this purpose, the control apparatus 40 controls the actuating drives 35 as a function of the actuation of the other actuating drives 19. If, for example, the thrown-on position of the blanket cylinder 4 is displaced away from the impression cylinder 5 through the use of the adjusting apparatuses 7, in order to process paperboard sheets, the operating position, which is provided for the printing operation, of the form cylinder 3, is automatically also displaced away from the impression cylinder 5 to a corresponding extent. This prevents a situation in which the pressure or printing pressure between the form cylinder 3 and the blanket cylinder 4 during the printing operation is increased excessively as a consequence of the changeover of the adjusting apparatuses 7 of the blanket cylinder 4 from the paper position into the paperboard position. The printing pressure between the form cylinder 3 and the blanket cylinder 4 is kept constant for all thicknesses of printing material by the tracking of the position of the form cylinder 3.

After setting of the adjusting apparatuses 7 of the blanket cylinder 4 and of the adjusting apparatuses 29 of the form cylinder 3 has been carried out, the blanket cylinder 4 is displaced into its thrown-on position, in which the blanket cylinder 4 is in contact with the form cylinder 3 and with the printing material which is transported on the impression cylinder 5. In order to displace the blanket cylinder 4 into the thrown-on position, the actuating apparatus 17 is extended, with the result that the lever 13 presses, through the spring 32, onto the coupler 11 both on the drive side and on the operating side. In this case, the movement of the actuating apparatus 17 is transmitted to the operating side by the synchronizing shaft 15, in order to ensure that the lever 13 which is disposed there is also pivoted. The levers 13 are articulated in each case on a slide which is seated on the corresponding coupler 11 and is pushed on the coupler 11 by the pivoting movement of the respective lever 13. As a consequence of the displacement of the slides, the springs 12 are stressed, with the result that the latter each press increasingly onto one end-side head of the couplers 11. As a result, the couplers 11 are moved, as a result of which the eccentric bearings 8 are pivoted, until their projections 28 come into contact with the stops 20. After this, the blanket cylinder 4 is situated in its thrown-on position, in which a compensation for the tolerances which are present between the drive side and the operating side within the overall system is ensured by the elasticity of the springs 12 of the switching apparatus 6.

The control apparatus 40 allows the operator to actuate the actuating drives 35 (FIG. 4) independently of the other actuating drives 19 (FIGS. 2 and 3), which is advantageous for certain additional functions. One additional function relates to an operating mode of the printing press 1, in which the sheets pass through the printing unit 2, without being printed therein. In that case, the printing unit 2 is what is known as an inactive printing unit. In this operating mode, the sheets are printed in a further printing unit of the printing press 1. In this operating mode, the blanket cylinder 4 has to be kept in its thrown-on position in the inactive printing unit 2, in order to guide the sheets which are transported on the impression cylinder 5, and at the same time the form cylinder 3 has to be kept out of contact with the blanket cylinder 4 in this case. The form cylinder 3 has to be displaced away from the blanket cylinder 4 to such an extent that bearer rings of the form cylinder 3 are not in contact with bearer rings of the blanket cylinder 4 which is situated in the thrown-on position. The control apparatus 40 controls the actuating drives 35 in such a way that they rotate the eccentric bearings 30 to such an extent that the form cylinder 3 and its bearer rings are pulled back sufficiently far from the blanket cylinder 4 and its bearing rings.

Finally, it is to be noted that the switching apparatuses 6 which are shown in FIGS. 2 and 3 can also be used in a varnishing unit. In the varnishing unit, the form cylinder 3 and the associated adjusting apparatuses 29 are not present, and a varnishing cylinder is mounted in the eccentric bearings 8 instead of the blanket cylinder 4.

We claim:

1. A printing press, comprising:

a form cylinder;

a blanket cylinder;

an impression cylinder;

an adjusting apparatus having at least one first actuating drive for setting a printing pressure between said blanket cylinder and said impression cylinder, said at least one first actuating drive being an electric motor;

a tracking system for setting a printing pressure between said form cylinder and said blanket cylinder in dependence on said setting of said printing pressure between said blanket cylinder and said impression cylinder, said tracking system having at least one second actuating drive, said at least one second actuating drive being an electric motor;

an electronic control device coupling said at least one second actuating drive to said at least one first actuating drive in terms of control technology, for automatically adjusting said form cylinder relative to said blanket cylinder for setting the printing pressure between said form cylinder and said blanket cylinder;

a drive side, an operating side, and a switching apparatus for throwing said blanket cylinder on and off said impression cylinder, said switching apparatus having an eccentric bearing on said drive side and an eccentric bearing on said operating side, said blanket cylinder being mounted in said eccentric bearings; and a common, single actuating apparatus for rotating both of said eccentric bearings of said blanket cylinder, and a mechanism having a synchronizing shaft elastically connecting said eccentric bearings of said blanket cylinder to one another.

2. The printing press according to claim 1, which further comprises eccentric bearings mounting said form cylinder, a further second actuating drive of said tracking system, and spring limbs connecting said second actuating drives to said eccentric bearings.

3. The printing press according to claim 1, wherein said adjusting apparatus has a further first actuating drive and stops for determining end positions of said eccentric bearings of said blanket cylinder, and said at least one first actuating drive and said further first actuating drive adjust said stops.

* * * * *